US008486602B2

(12) United States Patent
Nosella et al.

(10) Patent No.: US 8,486,602 B2
(45) Date of Patent: Jul. 16, 2013

(54) TONER PARTICLES AND COLD HOMOGENIZATION METHOD

(75) Inventors: Kimberly D. Nosella, Mississauga (CA); Tie Hwee Ng, Mississauga (CA); Allan K. Chen, Oakville (CA); Abdisamed Sheik-Qasim, Etobicoke (CA); Melanie L. Davis, Hamilton (CA)

(73) Assignee: Xerox Corporation, Norwalk, CT (US)

( * ) Notice: Subject to any disclaimer, the term of this patent is extended or adjusted under 35 U.S.C. 154(b) by 432 days.

(21) Appl. No.: 12/604,040

(22) Filed: Oct. 22, 2009

(65) Prior Publication Data

US 2011/0097665 A1 Apr. 28, 2011

(51) Int. Cl.
*G03G 9/08* (2006.01)

(52) U.S. Cl.
USPC ..... 430/137.14

(58) Field of Classification Search
USPC ..... 430/137.14
See application file for complete search history.

(56) References Cited

U.S. PATENT DOCUMENTS

| | | | |
|---|---|---|---|
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,922,501 | A | 7/1999 | Cheng et al. |
| 5,925,488 | A | 7/1999 | Patel et al. |
| 5,928,829 | A | 7/1999 | Cheng et al. |
| 5,977,210 | A | 11/1999 | Patel et al. |
| 6,063,827 | A | 5/2000 | Sacripante et al. |
| 6,576,389 | B2 | 6/2003 | Vanbesien et al. |
| 6,593,049 | B1 | 7/2003 | Veregin et al. |
| 6,617,092 | B1 | 9/2003 | Patel et al. |
| 6,627,373 | B1 | 9/2003 | Patel et al. |
| 6,638,677 | B2 | 10/2003 | Patel et al. |
| 6,656,657 | B2 | 12/2003 | Patel et al. |
| 6,656,658 | B2 | 12/2003 | Patel et al. |
| 6,664,017 | B1 | 12/2003 | Patel et al. |
| 6,673,505 | B2 | 1/2004 | Jiang et al. |
| 6,756,176 | B2 | 6/2004 | Stegamat et al. |
| 6,830,860 | B2 | 12/2004 | Sacripante et al. |
| 2006/0222991 | A1 | 10/2006 | Sacripante et al. |
| 2008/0199797 | A1 | 8/2008 | Sacripante et al. |
| 2008/0233508 | A1* | 9/2008 | Kamiyoshi et al. ..... 430/110.3 |
| 2009/0246679 | A1 | 10/2009 | Nosella et al. |
| 2010/0285403 | A1* | 11/2010 | Sacripante et al. ..... 430/124.4 |

FOREIGN PATENT DOCUMENTS

| | | |
|---|---|---|
| GB | 1 442 835 | 7/1976 |

* cited by examiner

*Primary Examiner* — Janis L Dote
(74) *Attorney, Agent, or Firm* — Oliff & Berridge, PLC

(57) ABSTRACT

A method of making toner particles, including cold homogenizing at a temperature below room temperature a resin emulsion, a colorant, an optional wax, and optional additives with a coagulant to form a toner slurry; heating the toner slurry to form aggregated toner particles; freezing aggregation of the particles in the slurry once at a desired aggregated particle size; and further heating the aggregated particles in the slurry to coalesce the aggregated particles into toner particles.

20 Claims, No Drawings

TONER PARTICLES AND COLD HOMOGENIZATION METHOD

TECHNICAL FIELD

This disclosure is generally directed to a method for preparing a chemical toner, such as an emulsion aggregation toner. More specifically, this disclosure is directed to a method for making nanometer sized pre-aggregates with cold homogenization, which are then aggregated and coalesced into toner particles.

BACKGROUND

In the typical chemical toner process, such as an emulsion aggregation toner process, the resulting average toner particle size is of about 5.8 μm. Still, better image quality and lower toner coverage could be made possible by making toner particles with an even smaller average particle size. Nevertheless, with increasingly smaller toner particle sizes, it is more difficult to make a toner using current emulsion aggregation processes because of the relatively large particle size of the initial homogenized slurry particles.

In chemical emulsion aggregation processes, a mechanical homogenizer (such as a rotor-stator) is used to evenly disperse the coagulant into the toner slurry. Typically the homogenized slurry particle (pre-aggregated particle) size is about 3.3 μm at room temperatures (about 17-25° C.). Thus, to make a toner with a final average particle size of 3 or 4 μm is very difficult or impossible under the current processes. For example, to incorporate all the necessary components and still achieve a narrow geometric size distribution (GSD) while performing the necessary steps to make a toner, it would be very difficult when beginning with a 3 μm pre-aggregated particle.

As a result, there exists a need to develop a toner process with a smaller sized pre-aggregated particle that may subsequently be coalesced to achieve a much smaller particle sized final toner.

SUMMARY

The present disclosure in embodiments addresses these various needs and problems by providing a method of making toner particles, comprising:

cold homogenizing, at less than about 17° C., a resin emulsion, a colorant, an optional wax, and optional additives with a coagulant to form a homogenized toner slurry comprising pre-aggregated particles;

heating the slurry to form aggregated toner particles;

freezing aggregation of the particles in the slurry once at a desired aggregated particle size; and further heating the aggregated particles in the slurry to coalesce the aggregated particles into toner particles.

The cold homogenization is carried out at a temperature where the coagulant is inactivated or substantially inactivated.

These and other improvements are accomplished by the methods described in embodiments herein.

EMBODIMENTS

The current disclosure provides a process for making toner particles that includes adding a coagulant while homogenizing at less that about 17° C. with a resin emulsion, a colorant, an optional wax, and optional additives to form a slurry; heating the slurry to form aggregated particles in the slurry; freezing aggregation of the particles in the slurry once at a desired aggregated particle size; and further heating the aggregated particles in the slurry to coalesce the aggregated particles into toner particles. The initial average particle size is facilitated by cold homogenization, or homogenization at a temperature below room temperature.

Adding a coagulant while mixing at low temperatures can result in a poor particle size distribution of the toner slurry because in some cases, the coagulant is not completely deactivated and, thus, the homogenization step is still necessary to achieve the smallest particle size possible. Surprisingly, in embodiments of the present disclosure, homogenizing while at a cold temperature desirably results in a smaller homogenized particle size. During cold homogenization, as compared to the typical homogenization at room temperatures or above, the coagulant is inactivated either completely or partially, thus allowing for pre-aggregated particles of a smaller average size. When the coagulant is not completely inactivated, it cannot be added to the slurry along with the other components prior to homogenization, rather it can be added in during homogenization.

In embodiments, by introducing cold homogenization into the toner preparation process, the initial particle size can be reduced by a factor of 10 or of greater than 10 as compared with the typical chemical toner preparation processes carried out at room temperature. Being able to prepare much smaller pre-aggregate particles means that the subsequent aggregated particles and final toner particles can also be smaller and more uniform in size.

Typically the average pre-aggregated particle sizes for bench scale and manufacturing scale are about 2 and about 3 μm, respectively. To obtain, for example, a 4 μm toner, a shell mixture is typically added when the particle size is about 3.3 μm. A shell can add about 0.5 to about 1.5 μm or more to the particle diameter. As such, a pre-aggregated particle size of about 3.3 μm at the manufacturing scale is too big if the finished toner particles need to be smaller than those typically produced. Cold homogenization unexpectedly overcomes this problem.

Resins and Polymers

In embodiments, the process may be used to make various toners, for example, styrene acrylate toners, UV curable toners, and polyester toners.

Styrene resins and polymers are known in the art. In embodiments, specific styrene resins may be, for example, styrene-based monomers, including styrene acrylate-based monomers. Illustrative examples of such resins may be found, for example, in U.S. Pat. No. 5,853,943, U.S. Pat. No. 5,922,501, U.S. Pat. No. 5,928,829, the entire disclosures thereof being incorporated herein by reference.

Specific examples that may be utilized include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

UV curable resins are known in the art. In embodiments, UV curable resins may be unsaturated polymers that can be crosslinked in the presence of activating radiation such as ultraviolet light and a suitable photo initiator. Illustrative examples of such resins may be found, for example, in U.S. Patent Application Publication No. 2008-0199797, the entire disclosure thereof being incorporated herein by reference.

Polyester resins are also known in the art. The specific polyester resin or resins selected for the present disclosure include, for example, unsaturated polyester and/or its derivatives, polyimide resins, branched polyimide resins, sulfonated polyesters, and any of the various polyesters, such as crystalline polyesters, amorphous polyesters, or a mixture thereof. Thus, for example, the toner particles can be comprised of crystalline polyester resins, amorphous polyester resins, or a mixture of two or more polyester resins where one or more polyester is crystalline and one or more polyester is amorphous. Illustrative examples of such resins may be found, for example, in U.S. Pat. Nos. 6,593,049, 6,756,176, and 6,830,860, the entire disclosures thereof being incorporated herein by reference.

The resin may be a polyester resin formed by reacting a diol with a diacid in the presence of a catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfo-aliphatic diol can be selected in an amount of from about 0 to about 10 mole percent, in embodiments from about 1 to about 4 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly-(ethylene-sebacate), copoly(ethylene-fumarate)-copoly-(ethylene-decanoate), and copoly (ethylene-fumarate)-copoly-(ethylene-dodecanoate), and combinations thereof.

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates such as titanium (iv) butoxide or titanium (iv) iso-propoxide, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.001 mole percent to about 0.55 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include polystyrene-acrylate) resins, crosslinked, for example, from about 10 percent to about 70 percent, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-polystyrene-butadiene) resins, and crosslinked alkali sulfonated poly(styrene-butadiene) resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

Examples of other suitable latex resins or polymers which may be utilized include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), polystyrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymers may be block, random, or alternating copolymers.

In embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable amorphous polyester resin may be a poly(propoxylated bisphenol A co-fumarate) resin having the following formula (I):

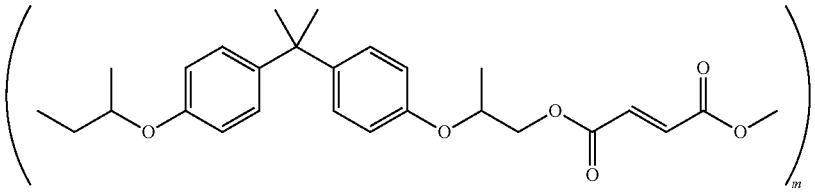

(I)

wherein m may be from about 5 to about 1000.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

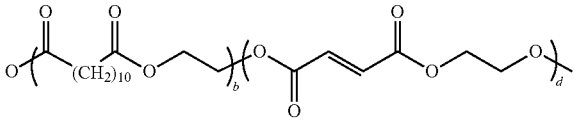

(II)

wherein b is from about 5 to about 2000 and d is from about 5 to about 2000.

The resin emulsion may comprise a first amorphous resin, a second amorphous resin different from the first amorphous resin, and a crystalline resin. In embodiments, the first amorphous resin, the second amorphous resin, and the crystalline resin may all comprise polyester.

One, two, or more toner resins/polymers may be used. In embodiments where two or more toner resins are used, the toner resins may be in any suitable ratio (e.g., weight ratio) such as for instance about 10% first resin:90% second resin to about 90% first resin:10% second resin. In embodiments, the amorphous resin utilized in the core may be linear.

In embodiments, the resin may be formed by emulsion polymerization methods. In other embodiments, a pre-made resin may be utilized to form the toner.

Surfactants

In embodiments, colorants, waxes, and other additives utilized to form toner compositions may be in dispersions including surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, TGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Waxes

In embodiments, the resin emulsion can be prepared to also include wax therein. In these embodiments, the emulsion will include resin and wax particles at the desired loading levels, which allows for a single resin and wax emulsion to be made rather than separate resin and wax emulsions. Further, in these embodiments, the combined emulsion allows for reduction in the amount of surfactant needed to prepare separate emulsions for incorporation into toner compositions. This is particularly helpful in instances where it would otherwise be difficult to incorporate the wax into the emulsion. However, in embodiments, the wax can also be separately emulsified, such as with a resin, and separately incorporated into final products.

In addition to the polymer binder resin, the toners of the present disclosure also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes and functionalized waxes. Examples of natural vegetable waxes include, for example, carnauba wax, candelilla wax, rice wax, sumacs wax, jojoba oil, Japan wax, and bayberry wax. Examples of natural animal waxes include, for example, beeswax, punic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

Examples of waxes of embodiments include polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 500 to about 2,000, such as from about 1,000 to about 1,500, while the commercially available polypropylenes utilized have a molecular weight of about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and Johnson Diversey, Inc. Many of the polyethylene and polypropylene compositions useful in embodiments are illustrated in British Pat. No. 1,442,835, the entire disclosure of which is incorporated herein by reference.

The toners may contain the wax in any amount of from, for example, about 1 to about 25 percent by weight of toner, such as from about 3 to about 15 percent by weight of the toner, on a dry basis; or from about 5 to about 20 percent by weight of the toner, such as from about 5 to about 11 percent weight of the toner.

Colorants

In embodiments, the toners may also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 0.1 percent to about 35 percent by weight based upon the total weight of the composition, such as from about 1 to about 25 percent by weight. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostapenn Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1 to about 35 percent by weight of the toner particles on a solids basis, such as from about 5 to about 25 percent by weight or from about 5 to about 15 percent by weight. However, amounts outside these ranges can also be used, in embodiments.

Coagulants

The emulsion aggregation process for making toners of the present disclosure also contains at least a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 2 to about 13, such as from about 3 to about 8 or from about 7 to about 11. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include, but are not limited to, tetraalkyl titivates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from 0 to about 5 percent by weight of the toner particles, such as from about greater than 0 to about 3 percent by weight of the toner particles.

Ion Solutions

In embodiments, salts, bases, buffers, and combinations of salts, bases, and buffers may be used to freeze the size of the aggregates.

Suitable salts or bases utilized to increase the pH and hence ionize the aggregate particles thereby providing stability and preventing the aggregates from growing in size include, but are not limited to, metallic salts of aliphatic acids or aromatic acids and bases, such as sodium hydroxide, ammonium hydroxide, sodium tetraborate, cesium hydroxide, potassium acetate, zinc acetate, sodium dihydrogen phosphate, disodium hydrogen phosphate, potassium formate, potassium hydroxide, sodium oxalate, sodium phthalate, potassium salicylate, combinations thereof, and the like.

Suitable buffers may also be used. In embodiments, a buffer system may include at least two of acids, salts, bases, organic compounds, and combinations thereof in a solution with deionized water as the solvent. The bases may be selected from those listed above. Suitable acids that can be utilized include, but are not limited to, organic and/or inorganic nitric acids such as sulfuric acid, hydrochloric acid, acetic acid, citric acid, trifluoro acetic acid, succinic acid, salicylic acid, combinations thereof, and the like. Suitable organic compounds include, but are not limited to, tris(hydroxymethyl)aminomethane ("TRIS"), Tricine, Bicine, Glycine, sodium acetate, HEPES, Trietholamine hydrochloride, MOPS, combinations thereof, and the like.

In embodiments, salts, bases, acids, buffers, and combinations of salts, bases, acids, and buffers may be used to coalesce the particles. Examples of such salts, bases, acids, buffers, and combinations thereof may be found in U.S. patent application Ser. No. 12/056,337, the entire disclosure of which is incorporated herein by reference.

Emulsion Aggregation Procedures

Any suitable emulsion aggregation procedure may be used in forming the emulsion aggregation toner particles without restriction. These procedures typically include the basic process steps of at least aggregating an emulsion containing polymer binder and one or more optional waxes, one or more colorants, one or more surfactants, an optional coagulant, and one or more additional optional additives to form aggregates, subsequently coalescing or fusing the aggregates, and then recovering, optionally washing, and optionally drying the obtained emulsion aggregation toner particles.

Cold homogenization according to this disclosure allows for a better distribution of the coagulant because at lower temperatures (e.g. <17° C.), the coagulant is at least partially inactive, resulting in a smaller initial homogenization particle size. This, in turn enables better control of particle size, better control of GSD, and decreases particle coarseness. Thus, in embodiments, the temperature may be adjusted so that the coagulant is partially inactivated, which includes inactivated, substantially inactive, or reduced in its activity. This inactivation results in a smaller particles size and allows for addition of the coagulant to the slurry at any time during the homogenization of the slurry particles. In embodiments, slurries containing partially inactivated coagulants require homogenization to reduce coarse particles to a coarse % of from about 1% to about zero, or from about 0.5% to about zero.

In embodiments, the temperature during homogenization may also be adjusted to a particular temperature or temperature range designed to effect the particle size of the slurry particles. As such, particle size can be controlled by tuning the temperature of the slurry during homogenization.

In embodiments, the above procedures include cold homogenization. "Cold" includes any temperature below room temperature (about 17-25° C.). Cold homogenization may be carried out at, for example, less than about 17° C., such as less than about 15° C., less than 10° C. such as less than about 9° C., or less than about 4° C. In embodiments, cold homogenization may be carried out at about 0.5 to about 17° C., about 0.5 to about 15° C., about 0.5 to about 9° C., or about 0 to about 4° C.

By introducing a cold homogenization process during the addition of the coagulant, the initial particle size can be reduced by a factor of 10 or greater than 10. For example, the particle size can be reduced in the lab from about 1.7 μm to about 170 nm. In the plant, the particle size can be reduced by a factor greater than 10, for example from about 3.3 μm to about 209 nm.

In embodiments, the particles resulting from cold homogenization are from about 2.8 μm (2800 nm) to about 100 nm, such as about 200 nm, about 300 nm, or about 400 nm. Thus the particles may be about 2.8 μm or less, such as about 1 μm or less, about 400 nm or less, about 300 nm or less, about 200 nm or less, or about 100 nm or less.

In embodiments, the finished toner particles resulting from the above particles may be as large as about 20 μm. The finished toner particles may also be much smaller, such as from about 4.9 μm to about 2.5 μm, or from about 4.5 μm to about 3 μm. Thus the particles may be about 4.9 μm or less, such as about 4 μm or less, or about 3 μm.

It is also desirable to control the toner particle size and limit the amount of both fine and coarse toner particles in the toner. In an embodiment, the toner particles have a very narrow particle size distribution with a lower number GSD of about 1.15 to about 1.30, or about less than 1.25. The toner particles of the present disclosure also can have a size such that the upper GSD by volume is in the range of from about 1.15 to about 1.30, such as from about 1.18 to about 1.22, or less than about 1.25. These GSD values for the toner particles of the present disclosure indicate that the toner particles are made to have a very narrow particle size distribution.

In embodiments, the toner particles have a GSD by number that is less than or equal to about 1.30. The toner particles of the present disclosure also can have a size such that the GSD by volume of the particles is less than or equal to about 1.25.

In embodiments, average particle coarse % is also reduced when compared with particles produced by conventional emulsion aggregation methods. For example, in conventional methods, coarse % may be from about 5 to about 1.1. However, in embodiments employing cold homogenization, coarse % can be from about 1 to about zero.

Suitable emulsion aggregation/coalescing processes for the preparation of toners, and which can be modified to include cold homogenization as described herein, are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox patents U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. patents may be selected for the present composition and process in embodiments thereof.

EXAMPLES

The following examples exemplify the above described cold-homogenization process and the advantageous results thereof.

Example 1

A UV curable resin amorphous emulsion (XP777, commercially available as "XP777" from Reichhold, Inc.) with a photoinitiator (commercially available as "IRGACURE819" from Ciba Specialty Chemicals, Inc.) was homogenized with a crystalline emulsion (a copoly(ethylene-dodecanoiate)-copoly (ethylene-fumerate), a pigment (cyan 15:3), and a surfactant (DOWFAX) at 4° C. The homogenized mixture contained 10% solids. This procedure was repeated for a second run. For each run, the particle size was measured using Coulter and Nanotrac. The results are shown in Table 1 (below).

Comparative Example 1

The process of Example 1 was repeated in two additional runs, except at 25° C. For each run, the particle size was measured using Coulter and Nanotrac. The results are shown in Table 1 (below).

Example 2

The process of Example 1 was repeated in two additional runs, except with 15% solids. For each run, the particle size was measured using Coulter and Nanotrac. The results are shown in Table 1 (below).

Comparative Example 2

The process of Example 2 was repeated in two additional runs, except at 25° C. For each run, the particle size was measured using Coulter and Nanotrac. The results are shown in Table 1 (below).

The results of the above examples are summarized in Table 1 (below). Homogenization temperature was found to be a major factor in initial particle size after homogenization. The percent of solids in the mixture had a small impact on the resulting particle size.

TABLE 1

| Examples | % Solids | Homogenization Temperature (° C.) | Run 1: Particle Size (μm)* | Run 2: Particle Size (μm)* |
|---|---|---|---|---|
| 1 | 10 | 4 | 0.174 | 0.161 |
| Comp. 1 | 10 | 25 | 1.789 | 1.827 |
| 2 | 15 | 4 | 0.182 | 0.182 |
| Comp. 2 | 15 | 25 | 1.905 | 1.942 |

Example 3

The above procedure was repeated with 12.5% solids at 19° C. homogenization temperature. An average particle size of 1.3915 was achieved, thus further verifying the above results and model.

Although UV curable toners are used as the examples below, cold homogenization can be used for any non-UV curable program or Emulsion Aggregation based toners, to obtain a toner particle size smaller than or equal to 4 μm.

Example 4

To further confirm the above results, a 20 Gal batch of cyan UV curable toner was made using cold homogenization at 9° C., toner slurry % solids of 13 and all the same raw materials as the above toners. This scaled-up toner achieved a particle size of 209 nm.

In contrast, the above toner has particle sizes after homogenization of 3.018 to 3.530 μm when homogenized at room temperatures of 19 to 24° C. Thus, the cold homogenization trend found in the lab is mirrored in scale up operations.

The following three examples demonstrate the advantages of cold homogenization. Examples 5 and 6 are carried out at the bench scale (2 L). Example 5 is carried out with cold homogenization and Example 6 is homogenized a room temperature. Example 7 is carried out at pilot plant scale (20 Gal) with cold homogenization. The resulting toners have all the same formulation scaled to their correct loadings.

Example 5

4 μm Cyan UV Curable Toner with Cold Homogenization

A cyan polyester ultra low melt toner with UV initiator was prepared at the 2 L Bench scale (180 g dry theoretical toner). A mixture was prepared with the materials of Example 1. The mixture was then cooled in an ice bath to 3-4° C.; then pH adjusted to 4.2 using 0.3M nitric acid. The slurry was then homogenized for a total of 5 minutes at 3000-4000 rpm while adding in the coagulant, aluminum sulphate. Once completed, the sample was quenched in 4% NaOH and DIW and taken for particle size measurement on the Nanotrac. Initial particle size (D50) was recorded at 168.4 nm with a standard deviation of 0.0741.

The slurry was then transferred to the 2 L Buchi at room temperature set mixing at 1000 rpm, and was aggregated at a batch temperature of 26° C. During aggregation, a shell comprised of the same amorphous emulsion in the core was added to achieve the targeted particle size. The aggregation step was frozen with pH adjustment using Sodium Hydroxide (NaOH) and EDTA. The process proceeded with the reactor temperature (Tr) being increased to achieve 68° C. while adjusting the pH down to 6.2 using pH 5.7 buffer until the Tr was 67° C., where the particles began to coalesce. After about 1 hr, the particles achieved >0.970 and were cooled.

Example 6

4 μm Cyan UV Curable Toner with Room Temperature Homogenization

A mixture was prepared with the materials of Example 1. The mixture was pH adjusted to 4.2 using 0.3M nitric acid. The slurry was then homogenized at room temperature (17-25° C.) for a total of 5 minutes at 3000-4000 rpm while adding in the coagulant, aluminum sulphate. Once completed, the sample was quenched in 4% NaOH and DIW and taken for particle size measurement on the Nanotrac. Initial particle size (D50) was recorded at 1110 nm with a standard deviation of 0.608.

The slurry was then transferred to the 2 L Buchi at room temperature set mixing at 1000 rpm, and was aggregated at a batch temperature of 26° C. During aggregation, a shell comprised of the same amorphous emulsion in the core was added to achieve the targeted particle size. The aggregation step was frozen with pH adjustment using Sodium Hydroxide (NaOH) and EDTA. The process proceeded with the reactor temperature (Tr) being increased to achieve 68° C. while adjusting the pH down to 6.2 using pH 5.7 buffer until Tr is 67° C., where the particles began to coalesce. After about 1 hr, the particles achieved >0.970 and were cooled.

Example 7

4 μm Cyan UV Curable Toner with Cold Homogenization (~9° C.)

The toner of Example 5 was prepared at the 20 Gal pilot plant scale (8.5 kg dry theoretical toner). A mixture was prepared with the materials of Example 1. The mixture was then cooled in an ice bath to about 9° C. then pH adjusted to 3.6 using 0.3M nitric acid. Once all the coagulant (aluminum sulphate) was added in-line through the homogenizer, the rpm was increased to 290 and a sample was taken after 1 minute. The sample was quenched in 4% NaOH and DIW and taken for particle size measurement on the Nanotrac. Initial particle size (D50) was recorded at 209.4 nm with a standard deviation of 0.0776.

The homogenizer was stopped, mixing in the reactor increased to 385 rpm, and the slurry was aggregated at a batch temperature of 26.8° C. During aggregation, a shell comprised of the same amorphous emulsion in the core was added to achieve the targeted particle size. The aggregation step was frozen with pH adjustment using Sodium Hydroxide (NaOH), pH 9 TRIS-HCl buffer, and EDTA. The process proceeded with the reactor temperature (Tr) being increased to achieve 68° C. while adjusting the pH down to 5.7 using pH 5.7 buffer until Tr was 67° C., where the particles began to coalesce. After about 2 hrs, the particles achieved >0.970 circularity and were cooled.

Below is a table summarizing the results:

| Examples | D50 (μm) | GSDv | GSDn | fines (1.3-2 μm) | Circu-larity | Coarse (>25 μm) |
|---|---|---|---|---|---|---|
| Example 5 | 4.05 | 1.25 | 1.27 | 3.25% | 0.976 | 1.31% |
| Example 6 | 3.96 | 1.23 | 1.28 | 4.78% | 0.972 | 4.7% |
| Example 7 | 3.68 | 1.23 | 1.26 | 4.78% | 0.971 | 0% |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of making toner particles, comprising:

cold homogenizing a resin emulsion, a colorant, an optional wax, and optional additives with a coagulant to form a homogenized toner slurry comprising pre-aggregated particles at a temperature of less than about 15° C.;

heating the slurry to form aggregated toner particles;

freezing aggregation of the particles in the slurry once at a desired aggregated particle size; and further heating the aggregated particles in the slurry to coalesce the aggregated particles into toner particles.

2. The method of claim 1, wherein the homogenizing is carried out at a temperature of less than about 9° C.

3. The method of claim 1, wherein the homogenizing is carried out at a temperature of less than about 4° C.

4. The method of claim 1, wherein the pre-aggregated particles have an initial average particle size of less than about 2.8 μm.

5. The method of claim 1, wherein the pre-aggregated particles have an initial average particle size of less than about 1 μm.

6. The method of claim 1, wherein the pre-aggregated particles have an initial average particle size of less than about 200 nm.

7. The method of claim 1, wherein the coagulant is added to the slurry during homogenization.

8. The method of claim 1, wherein homogenizing is carried out at a temperature that at least partially inactivates the coagulant.

9. The method of claim 1, wherein the resin emulsion comprises a crystalline resin.

10. The method of claim 1, wherein the resin emulsion comprises an amorphous polyester resin and a crystalline polyester resin.

11. The method of claim 1, wherein the resin emulsion comprises a first amorphous resin, a second amorphous resin different than said first amorphous resin, and a crystalline resin.

12. The method of claim 11, wherein said first amorphous resin, said second amorphous resin and said crystalline resin all comprise polyester.

13. The method of claim 1, wherein the toner particle size is about 2.5 to about 4.5 μm.

14. The method of claim 1, wherein the lower number GSD of the toner particles is from about 1.15 to about 1.30.

15. The method of claim 1, wherein the upper GSD by volume of the toner particles is from about 1.15 to about 1.30.

16. The method of claim 1, wherein the resin emulsion comprises a UV curable resin and the optional additives comprise a photoinitiator.

17. The method of claim 1, wherein the coagulant comprises a coagulant selected from the group consisting of a monovalent metal coagulant, a divalent metal coagulant, and a polyion coagulant.

18. The method of claim 1, wherein the optional additives comprise a surfactant.

19. A method of making toner particles, comprising:

cold homogenizing a resin emulsion, a colorant, an optional wax, and optional additives with a coagulant to form a homogenized toner slurry comprising pre-aggregated particles at a temperature between about 0.5° C. and about 9° C.;

heating the slurry to form aggregated toner particles;

freezing aggregation of the particles in the slurry once at a desired aggregated particle size; and further heating the aggregated particles in the slurry to coalesce the aggregated particles into toner particles.

20. A method of making toner particles, comprising:

cold homogenizing a resin emulsion, a colorant, an optional wax, and optional additives with a coagulant to form a homogenized toner slurry comprising pre-aggregated toner particles at a temperature of from about 0° C. to about 4° C., wherein the coagulant is completely inactivated during the cold homogenizing;

heating the slurry to form aggregated toner particles;

freezing aggregation of the particles in the slurry once at a desired aggregated particle size; and further heating the aggregated particles in the slurry to coalesce the aggregated particles into toner particles.

* * * * *